US006784769B1

(12) United States Patent
Chen

(10) Patent No.: US 6,784,769 B1
(45) Date of Patent: Aug. 31, 2004

(54) MICRO MACHINE SWITCH

(75) Inventor: Shuguang Chen, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/130,149

(22) PCT Filed: Nov. 18, 1999

(86) PCT No.: PCT/JP99/06439

§ 371 (c)(1),
(2), (4) Date: May 16, 2002

(87) PCT Pub. No.: WO01/37303

PCT Pub. Date: May 25, 2001

(51) Int. Cl.[7] ..... H01P 1/10
(52) U.S. Cl. ..... 333/262; 333/105
(58) Field of Search ..... 333/262, 105, 333/197

(56) References Cited

U.S. PATENT DOCUMENTS 5,619,061 A 4/1997 Goldsmith et al.
6,433,657 B1 * 8/2002 Chen ..... 333/262

FOREIGN PATENT DOCUMENTS

EP 709911 A2 A3 5/1996
EP 0 874 379 A 10/1998
JP 04-133226 A 5/1992

OTHER PUBLICATIONS

S. Majumder et al., "Measurement and modeling of surface micromachined, electrostatically actuated microswitched", 1997 International Conference on Solid–State Sensors and Actuators, Digest of Technical Papers, Transducers 97, Chicago, IL Jun. 16–19, 1997. Sessions 3A1–4D3. Papers No. 3A1.01–4D3.14P, vol. 2, Jun. 16, 1997 pp. 1145–1148, XP010240681.

* cited by examiner

*Primary Examiner*—Brian Young
*Assistant Examiner*—Joseph J. Lauture
(74) *Attorney, Agent, or Firm*—Sughrue Mion, PLLC

(57) ABSTRACT

A switch includes at least two distributed constant lines (21*a*, 21*b*) disposed close to each other, a movable element (11) arranged above the distributed constant lines so as to oppose these distributed constant lines and connecting the distributed constant lines to each other in a high-frequency manner upon contacting the distributed constant lines, and a driving means (4) for displacing the movable element by an electrostatic force to bring the movable element into contact with the distributed constant lines. The movable element has at least two projection (32*a*–32*d*) formed by notching an overlap portion of the movable element which is located on at least one distributed constant line. The projections oppose a corresponding distributed constant line.

23 Claims, 11 Drawing Sheets

FIG. 3A
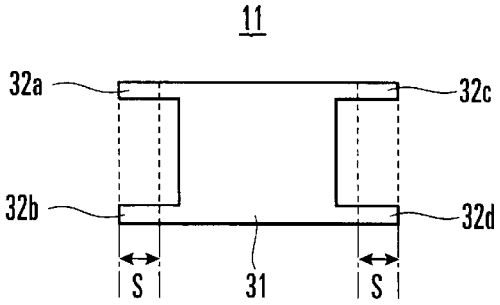
FIG. 3B
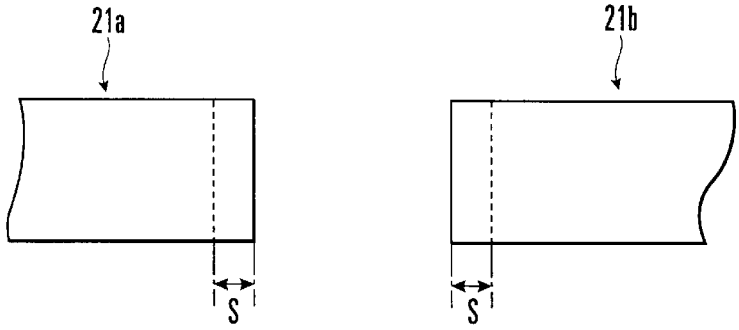
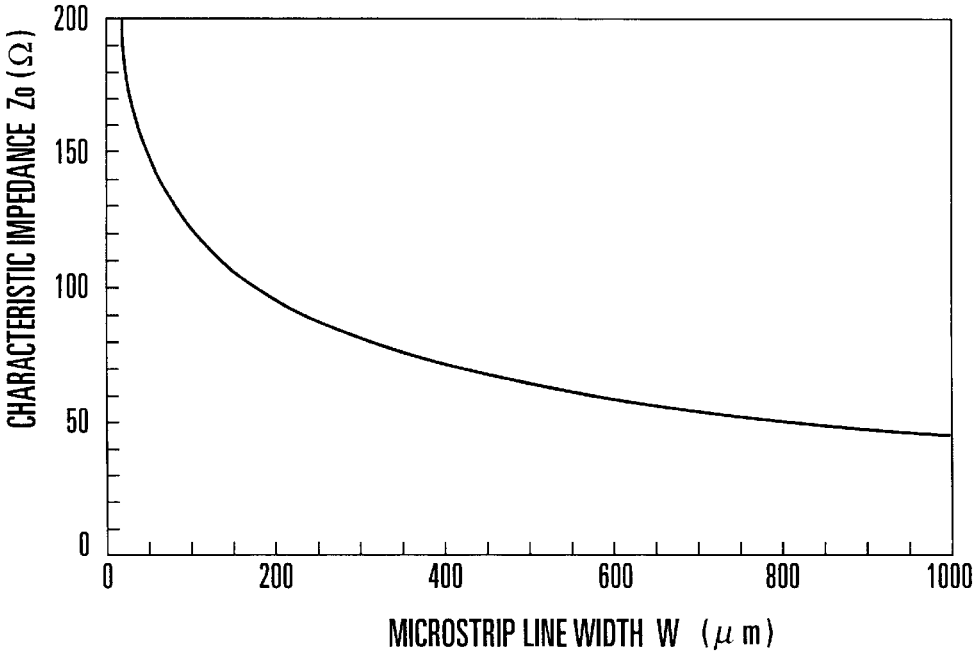
FIG. 4

MICRO MACHINE SWITCH

TECHNICAL FIELD

The present invention relates to a micromachine switch used in a milliwave band to microwave band.

BACKGROUND ART

Switch devices such as a PIN diode switch, HEMT switch, micromachine switch, and the like are used in a milliwave band to microwave band. Of these switches, the micromachine switch is characterized in that the loss is smaller than that of the other devices, and a compact high-integrated switch can be easily realized.

FIG. 21 is a perspective view showing the structure of a conventional micromachine switch. FIG. 22 is a plan view of the micromachine switch shown in FIG. 21.

A micromachine switch 101 is constructed by a switch movable element 111, support means 105, and switch electrode 104. The micromachine switch 101 is formed on a dielectric substrate 102 together with two RF microstrip lines 121*a* and 121*b*. A GND plate 103 is disposed on the lower surface of the dielectric substrate 102.

The microstrip lines 121*a* and 121*b* are closely disposed apart from each other at a gap G. The switch electrode 104 is disposed between the microstrip lines 121*a* and 121*b* on the dielectric substrate 102. The switch electrode 104 is formed to have a height lower than that of each of the microstrip lines 121*a* and 121*b*.

The switch movable element 111 is arranged above the switch electrode 104. A capacitor structure is formed by the switch electrode 104 and switch movable element 111.

As shown in FIG. 22, since a length L of the switch movable element 111 is larger than the gap G, two ends of the switch movable element 111 oppose the end portions of the microstrip lines 121*a* and 121*b*, respectively. The switch movable element 111 is formed to have a width g equal to a width W of each of the microstrip lines 121*a* and 121*b*.

The switch movable element 111 is cantilevered on the support means 105 fixed on the dielectric substrate 102.

As shown in FIG. 21, the switch movable element 111 is generally arranged above the microstrip lines 121*a* and 121*b*. With this structure, since the switch movable element 111 is not in contact with the microstrip lines 121*a* and 121*b*, the micromachine switch 101 is in an OFF state. At this time, a little high-frequency energy is transmitted from the microstrip line 121*a* to the microstrip line 121*b*.

When, however, a control voltage is applied to the switch electrode 104, the switch movable element 111 is pulled down by an electrostatic force. When the switch movable element 111 is brought into contact with the microstrip lines 121*a* and 121*b*, the switch movable element 111 is set in an ON state. At this time, the high-frequency energy from the microstrip line 121*a* is transmitted to the microstrip line 121*b* through the switch movable element 111.

As described above, the two ends of the switch movable element 111 oppose the microstrip lines 121*a* and 121*b*, respectively. Accordingly, the capacitor structures are also formed between the switch movable element 111 and the microstrip lines 121*a* and 121*b*.

This makes the capacitive coupling between the switch movable element 111 and microstrip lines 121*a* and 121*b* so that the high-frequency energy from the microstrip line 121*a* leaks out into the microstrip line 121*b* even if the micromachine switch 101 is in the OFF state. That is, in the conventional micromachine switch 101, an OFF isolation characteristic is poor.

A capacitance between the switch movable element 111 and the microstrip lines 121*a* and 121*b* is proportional to the opposing area between them. Accordingly, an increase in opposing area increases energy leakage, thereby degrading the isolation characteristic. On the contrary, a decrease in opposing area may improve the isolation characteristic. Therefore, the isolation characteristic can be improved by decreasing the width g of the switch movable element 111.

However, a high-frequency characteristic impedance of a line is related to the surface area of the line, and a decrease in width of the line increases the characteristic impedance. Thus, if the width g of the switch movable element 111 decreases, the characteristic impedance on the gap G increases in the ON state of the micromachine switch 111.

High-frequency energy reflection occurs at a discontinuous portion in the line. An increase in characteristic impedance on the gap G results in impedance mismatching. Thus, since the reflection increases in the ON state of the micromachine switch 101, the ON reflection characteristics degrades.

For example, the microwave switching circuit requires the isolation characteristic of approximately 15 dB or more and the reflection characteristics of approximately −20 dB or less.

The present invention has been made to solve the above problem, and has as its object to suppress the degradation of the ON reflection characteristic of the micromachine switch and improve the OFF isolation characteristic.

DISCLOSURE OF INVENTION

In order to achieve the above object, the present invention comprises at least two distributed constant lines disposed close to each other, a movable element arranged above the distributed constant lines such that distal end portions of the movable element oppose the distributed constant lines, respectively, and connecting the distributed constant lines to each other in a high-frequency manner upon contacting the distributed constant lines, and driving means for displacing the movable element by an electrostatic force to bring the movable element into contact with the distributed constant lines, wherein the movable element has at least two projections formed by notching an overlap portion of the movable element which is located on at least one distributed constant line side, and the projections oppose a corresponding distributed constant line. This decreases the opposing area between the movable element and the distributed constant line, thereby reducing the capacitive coupling of the movable element and distributed constant line without decreasing the width of the movable element. When the projection has a width (the length in the direction parallel to the widthwise direction of the distributed constant lines) 1/n (where n is a real number larger than 1) the width of the movable element main body (a portion of the movable element except for the projections), the projection has a high-frequency characteristic impedance much lower than n times the characteristic impedance of the movable element main body. On the other hand, the characteristic impedance of an end portion of the movable element is the synthetic impedance of the projections formed in parallel. Therefore, even the end portion of the movable element can obtain the characteristic impedance almost equal to that of the movable element main body, thereby suppressing the degradation of an ON reflection characteristic of the micromachine switch and improving an OFF isolation characteristic.

In the present invention, movable element main body serving as a portion of the movable element except for projections has a width serving as a length in a direction parallel to the widthwise direction of the distributed constant lines to be equal to a width of each of the distributed constant lines, and, a portion of the overlap portion of the movable element except for two ends in the movable element is notched. With this structure, the characteristic impedance on a gap becomes almost equal to that of each of the distributed constant lines. Thus, the degradation of an ON reflection characteristic of the micromachine switch can be prevented and an OFF isolation characteristic can be improved.

In the present invention, movable element main body serving as a portion of the movable element except for projections has a width serving as a length in a direction parallel to the widthwise direction of the distributed constant lines to be smaller than a width of each of the distributed constant lines, and a portion of the overlap portion of the movable element except for two ends in the movable element is notched. With this structure, even if the positioning error occurs in the widthwise direction of the movable element, all the projections can oppose the distributed constant lines, thereby suppressing the degradation of an ON reflection characteristic of the micromachine switch in that case.

In the present invention, a portion of the movable element having the projections is formed by notching two ends of the overlap portion of the movable element such that a width serving as a length in a direction parallel to the widthwise direction of the distributed constant lines is smaller than a width of each of the distributed constant lines. With this structure, the width of the portion of the movable element having the projections is smaller than that of the distributed constant line, thereby obtaining the same effect as in the above invention.

In this case, the width of the movable element main body serving as a portion of the movable element except for the projections may be equal to the width of the distributed constant lines. With this structure, the characteristic impedance on a gap becomes almost equal to that of each of the distributed constant lines. Thus, the degradation of an ON reflection characteristic of the micromachine switch can be prevented and an OFF isolation characteristic can be improved.

In the present invention, each of the projections has a rectangular shape. Thus, even if the positioning error occurs in the longitudinal direction of the movable element, the opposing area between the movable element and distributed constant lines is a predetermined area. Accordingly, a desired isolation characteristic can be obtained even in the above case.

In the present invention, a length, serving as a width of each of the projections, in a direction parallel to the widthwise direction of the distributed constant lines near the movable element main body serving as a portion of the movable element except for the projection is made larger than that away from the movable element main body. This increases a mechanical strength of the projections.

In the present invention, the movable element has a connection portion for connecting distal ends of the projections to each other. Thus, all the projections are simultaneously brought into contact with the distributed constant lines in an ON state of the micromachine switch, thereby improving an ON reflection characteristic.

In the present invention, at least one distributed constant line opposing the projections of the movable element does not oppose a movable element main body serving as a portion of the movable element except for the projections. That is, only the distal end portions of the projections of the movable element oppose the distributed constant lines. This greatly reduces the opposing area between the movable element and distributed constant lines, thereby obtaining a good OFF isolation characteristic.

In the present invention, at least one distributed constant line opposing the projections of the movable element also opposes a movable element main body serving as a portion of the movable element except for the projection. That is, the projections of the movable element and a part of the movable element main body oppose the distributed constant lines. Thus, a discontinuous portion of the micromachine switch in an ON state is only a portion where the movable element is in contact with the distributed constant lines, thereby obtaining a good OFF reflection characteristic.

Also, the present invention comprises at least two distributed constant lines disposed close to each other, a movable element arranged above the distributed constant lines such that distal end portions of the movable element oppose the distributed constant lines, respectively, and including a conductor, and driving means for displacing the movable element by an electrostatic force to bring the movable element into contact with the distributed constant lines, wherein at least one distributed constant line has at least two projections formed by notching an overlap portion of at least one distributed constant line, and the projections oppose the movable element. This can suppress the degradation of an ON reflection characteristic of the micromachine switch and improve an OFF isolation characteristic.

In the present invention, a width of the movable element serving as a length in a direction parallel to the widthwise direction of the distributed constant lines is equal to a width of a distributed constant line main body serving as a portion of at least one distributed constant line except for the projections, and at least one distributed constant line having the projections has a notched portion of the overlap portion of at least one distributed constant line except for two ends. With this structure, the characteristic impedance on a gap becomes almost equal to that of each of the distributed constant lines. Thus, the degradation of an ON reflection characteristic of the micromachine switch can be prevented and an OFF isolation characteristic can be improved.

In the present invention, a width of the movable element serving as a length in a direction parallel to the widthwise direction of the distributed constant lines is larger than a width of a distributed constant line main body serving as a portion of at least one distributed constant line except for the projections, and at least one distributed constant line having the projections has a notched portion of the overlap portion of at least one distributed constant line except for two ends. With this structure, even if the positioning error occurs in the widthwise direction of the movable element, all the projections can oppose the movable element, thereby suppressing the degradation of an ON reflection characteristic of the micromachine switch in that case.

In the present invention, a portion of at least one distributed constant line having the projections is formed by notching two ends of the overlap portion of at least one distributed constant line on the movable element side such that a width of a portion at which the projections are formed is smaller than a length in a direction parallel to the widthwise direction of the distributed constant lines. With this structure, the width of the portion of at least one distributed constant line having the projections is smaller than that of the movable element, thereby obtaining the same effect as in the above invention.

In this case, the width of the movable element may be equal to the width of a distributed constant line main body serving as a portion of at least one distributed constant line except for the projections. With this structure, the characteristic impedance on a gap becomes almost equal to that of each of the distributed constant lines. Thus, the degradation of an ON reflection characteristic of the micromachine switch can be prevented and an OFF isolation characteristic can be improved.

In the present invention, each of the projections has a rectangular shape. Thus, even if the positioning error occurs in the longitudinal direction of the movable element, the opposing area between the movable element and distributed constant lines is a predetermined area. Accordingly, a desired isolation characteristic can be obtained even in the above case.

In the present invention, the movable element does not oppose a distributed constant line main body serving as a portion, except for the projections, of at least one distributed constant line having the projections. That is, only the distal end portions of the projections of at least one distributed constant line oppose the movable element. Thus, a good OFF isolation characteristic can be obtained.

In the present invention, the movable element also opposes a part of a distributed constant line main body, which serves as a portion except for the projection of at least one distributed constant line having the projections. That is, the projections and a part of at least one distributed constant line main body oppose the movable element. Thus, a good OFF reflection characteristic can be obtained.

In addition, the present invention comprises at least two distributed constant lines disposed close to each other, a movable element arranged above the distributed constant lines such that distal end portions of the movable element oppose the distributed constant lines, respectively, and connecting the distributed constant lines to each other in a high-frequency manner upon contacting the distributed constant lines, and driving means for displacing the movable element by an electrostatic force to bring the movable element into contact with the distributed constant lines, wherein at least one distributed constant line has at least two first projections formed by notching an overlap portion of at least one distributed constant line, and the movable element has at least two second projections so formed as to oppose the first projections of at least one distributed constant line by notching an overlap portion of the movable element. This can suppress the degradation of an ON reflection characteristic of the micromachine switch and improve an OFF isolation characteristic.

In the present invention, at least an entire lower surface of the movable element is made of a conductor.

In the present invention, the movable element is made of a conductive member, and an insulating thin film formed on an entire lower surface of the conductive member.

In the present invention, the driving means comprises an electrode which is disposed apart between the distributed constant lines to oppose the movable element and to which a driving voltage is selectively applied.

In the present invention, the switch further comprises support means for supporting the movable element, the driving means is made of an upper electrode attached to the support means, and a lower electrode disposed under the upper electrode and opposing the upper electrode, and a driving voltage is selectively applied to at least one of the upper and lower electrodes.

BRIEF DESCRIPTION OF DRAWINGS

FIGS. 3A and B show plan views of the main part of the micromachine switch shown in FIG. 1;

FIG. 4 is a graph showing the relationship between the width of the microstrip line and the characteristic impedance;

BEST MODE OF CARRYING OUT THE INVENTION

A micromachine switch according to embodiments of the present invention will be described in detail below with reference to the accompanying drawings. A micromachine switch to be described here is a microswitch suitable for integration by a semiconductor element manufacturing process.

In a microstrip line (distributed constant line), the length of the microstrip line in a longitudinal direction is defined as a "length", and the length of the microstrip line in a widthwise direction perpendicular to the longitudinal direction is defined as a "width". In a movable element, the length in a direction parallel to the longitudinal direction of the microstrip line is defined as "length", and the length in a direction parallel to the widthwise direction of the microstrip line is defined as a "width".

First Embodiment

Figure 1:
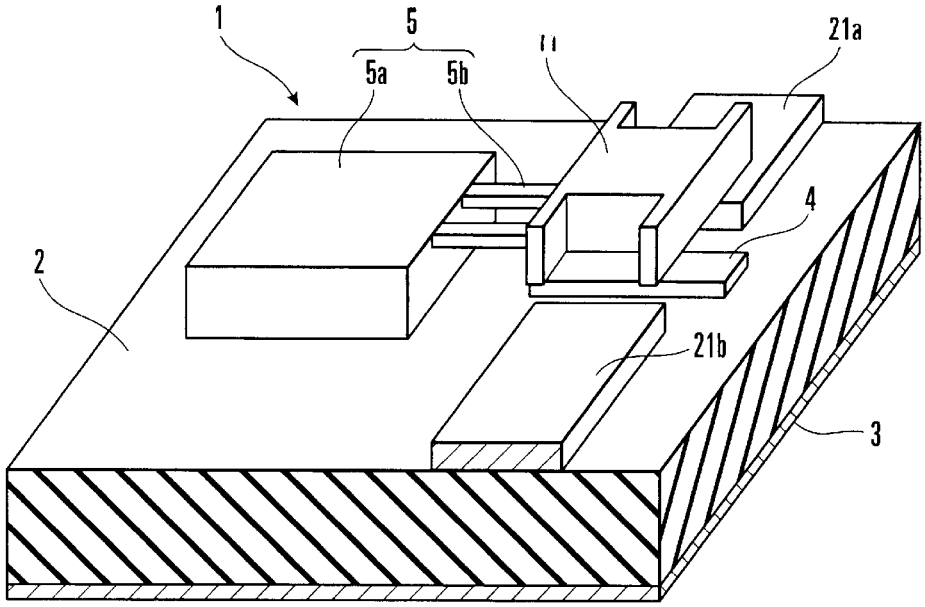
FIG. 1 is a perspective view showing the structure of a micromachine switch according to the first embodiment of the present invention.
Figure 2:
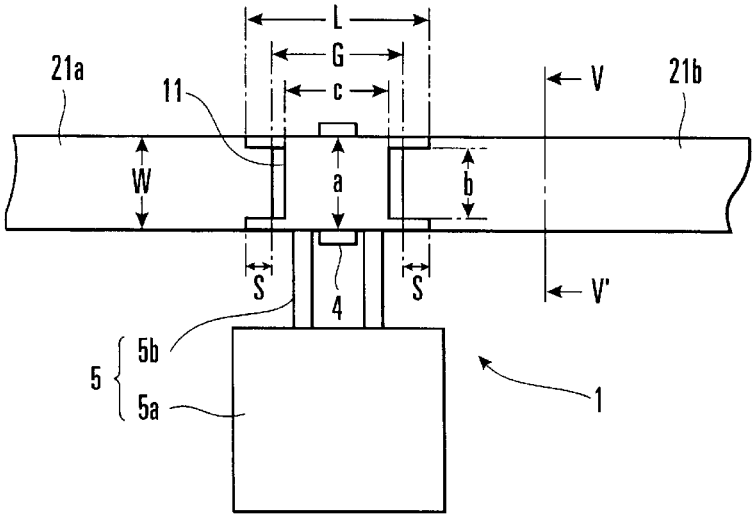
FIG. 2 is a plan view of the micromachine switch shown in FIG. 1.

FIG. 1 is a perspective view showing the structure of a micromachine switch according to the first embodiment of the present invention. FIG. 2 is a plan view of the micromachine switch shown in FIG. 1. FIG. 3 shows plan views of the main part of the micromachine switch shown in FIG. 1, in which FIG. 3(A) is a plan view of a switch movable element, and FIG. 3(B) is a plan view of the microstrip line.

As shown in FIG. 1, a micromachine switch 1 is constructed by a switch movable element 11, support means 5, and switch electrode (driving means) 4. The micromachine switch 1is formed on a dielectric substrate 2 together with two RF microstrip lines (distributed constant lines) 21*a* and 21*b*. A GND plate 3 is disposed on the lower surface of the dielectric substrate 2.

The microstrip lines 21*a* and 21*b* are closely disposed apart from each other at a gap G. The width of each of both microstrip lines 21*a* and 21*b* is W.

The switch electrode 4 is disposed apart between the microstrip lines 21*a* and 21*b* on the dielectric substrate 2. The switch electrode 4 is formed to have a height lower than that of each of the microstrip lines 21*a* and 21*b*. A driving voltage is selectively applied to the switch electrode 4 on the basis of an electrical signal.

The switch movable element 11 opposing the switch movable element 4 is arranged above the switch electrode 4. The switch movable element 11 includes a conductor for connecting the two microstrip lines 21*a* and 21*b* in a high-frequency manner.

On the other hand, the support means 5 for supporting the switch movable element 11 is constructed by a post portion 5*a* and arm portion 5*b*. The post portion 5*a* is fixed on the dielectric substrate 2 apart from the gap G between the microstrip lines 21*a* and 21*b* by a predetermined distance. The arm portion Sb extends from one end of the upper surface of the post portion 5*a* to the gap G. The support means 5 is made of a dielectric, semiconductor, or conductor.

The switch movable element 11 is fixed on a distal end of the arm portion 5*b* of the support means 5.

The shape of the switch movable element 11 shown in FIG. 1 will be described next with reference to FIGS. 2 and 3.

A length L of the switch movable element 11 is larger than the gap G between the microstrip lines 21*a* and 21*b*. Thus, in the switch movable element 11, portions each extending by a length (L−G)/2 (=S) from a corresponding one of the two ends of the switch movable element 11 oppose the microstrip lines 21*a* and 21*b*. Similarly, in the microstrip lines 21*a* and 21*b*, portions each extending by a length (L−G)/2 (=S) from a corresponding one of the two ends of each of the microstrip lines 21*a* and 21*b* oppose the switch movable element 11.

In the switch movable element 11, a portion of an edge of the switch movable element 11 except for the two ends on the microstrip line 21*a* side is notched in a rectangular shape having a width b (portions of an edge of the switch movable element 11 or 18 on the microstrip lines 21*a* and 21*b* sides will be referred to as overlap portions of the switch movable element 11 or 18, hereinafter). Thus, rectangular projections (second projections) 32*a* and 32*b* are formed on the two ends of one side on the microstrip line 21*a* side. Similarly, rectangular projections (second projections) 32*c* and 32*d* are also formed on the microstrip line 21*b* side.

In this case, an unnotched portion of the switch movable element 11 is defined as a movable element main body 31. Therefore, projections 32*a* to 32*d* are not included in the movable element main body 31, and the portion of the switch movable element 11 except for the projections 32*a* to 32*d* is the movable element main body 31. A width a of the movable element main body 31 of the switch movable element 11 is equal to the width W of each of the microstrip lines 21*a* and 21*b*.

Since a length c of the movable element main body 31 is a smaller than the gap G, the movable element main body 31 does not oppose the microstrip lines 21*a* and 21*b*. That is, only distal end portions of the projections 32*a* and 32*b* or projections 32*c* and 32*d* oppose the microstrip lines 21*a* or 21*b*.

Accordingly, when the micromachine switch 1 is in the ON state, base portions of the projections 32*a* and 32*b* or projections 32*c* and 32*d* are not brought into contact with the microstrip lines 21*a* or 21*b*. In this case, two parallel narrow lines are connected to a wide line.

If a line having the different impedance is connected to the line, a part of energy is reflected in the connecting portion. Thus, impedance matching between the microstrip lines 21*a* and 21*b* and the projections 32*a* to 32*d* of the switch movable element 11 need be considered.

FIG. 4 is a graph showing a relationship between the width W of the microstrip line and the characteristic impedance $Z_0$. In this example, the thickness of the dielectric substrate 2 is H=0.5 mm; and the relative dielectric constant of the dielectric substrate 2, $\in r=4.6$.

As is apparent from FIG. 4, in the microstrip line, a decrease in width W increases the characteristic impedance $Z_0$. However, the characteristic impedance $Z_0$ is not inversely proportional to the width W. That is, the width W of the microstrip line whose characteristic impedance $Z_0$ is doubled is much smaller than ½. Therefore, the impedance is matched between the wide microstrip line 21*a* (or 21*b*) and the two narrow projections 32*a* and 32*b* (or 32*c* and 32*d*).

In FIG. 4, for example, the characteristic impedance $Z_0$ of the microstrip line having the width W of 400 $\mu$m is 75Ω. In this case, the width of each of the projections 32*a* to 32*d* of the switch movable element 11 is set such that each of the projections 32*a* to 32*d* has the characteristic impedance of 150Ω. That is, the width of each of the projections 32*a* to 32*d* is set to 50 $\mu$m.

Note that, the value in this example is a value for the descriptive convenience of the method of deciding the width of each of the projections 32*a* to 32*d* of the switch movable element 11 and is not optimum value.

An operation of the micromachine switch 1 shown in FIG. 1 will be described next. FIG. 5 is a sectional view taken along the line V–V' of the micromachine switch 1 shown in FIG. 2, in which FIG. 5(A) shows the OFF state of the micromachine switch 1, and FIG. 5(B) shows the ON state.

Figure 5A:
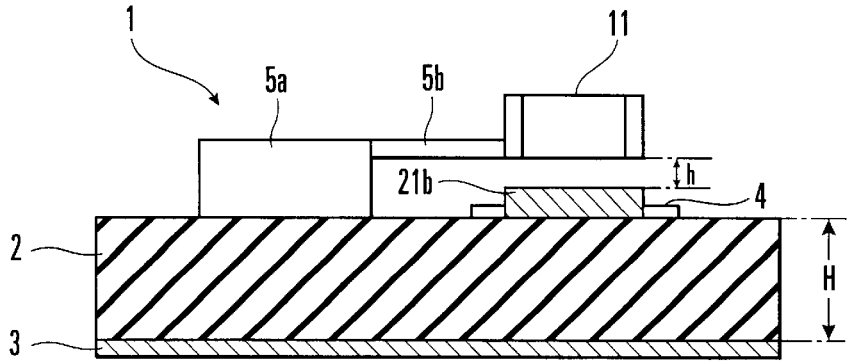
FIGS. 5A and B show sectional views taken along the line V–V' of the micromachine switch shown in FIG. 2.
Figure 5B:
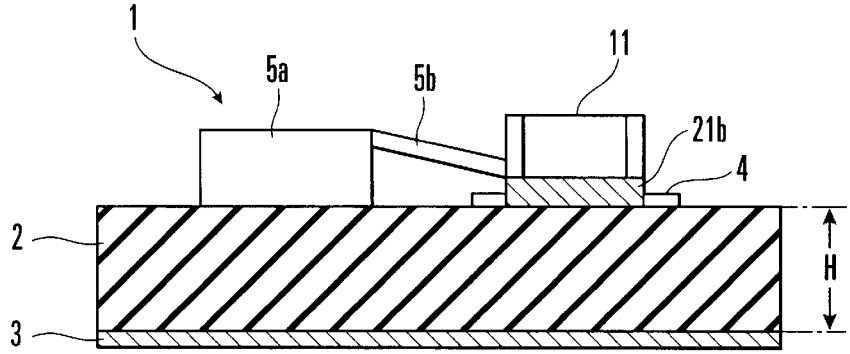

As shown in FIG. 5(A), the switch movable element 11 is generally positioned at a portion apart from the microstrip lines 21*a* and 21*b* by a height h. In this case, the height h is approximately several $\mu$m. If, therefore, no driving voltage is applied to the switch electrode 4, the switch movable element 11 is not in contact with the microstrip lines 21*a* and 21*b*.

However, the switch movable element 11 has the portions opposing the microstrip lines 21*a* and 21*b*. Since the capacitor structure is formed at these portions, the microstrip lines 21*a* and 21*b* are coupled to each other through the switch movable element 11.

A capacitance between the switch movable element 11 and the microstrip lines 21*a* and 21*b* is proportional to the opposing area between the switch movable element 11 and microstrip lines 21*a* and 21*b*.

Figure 21:
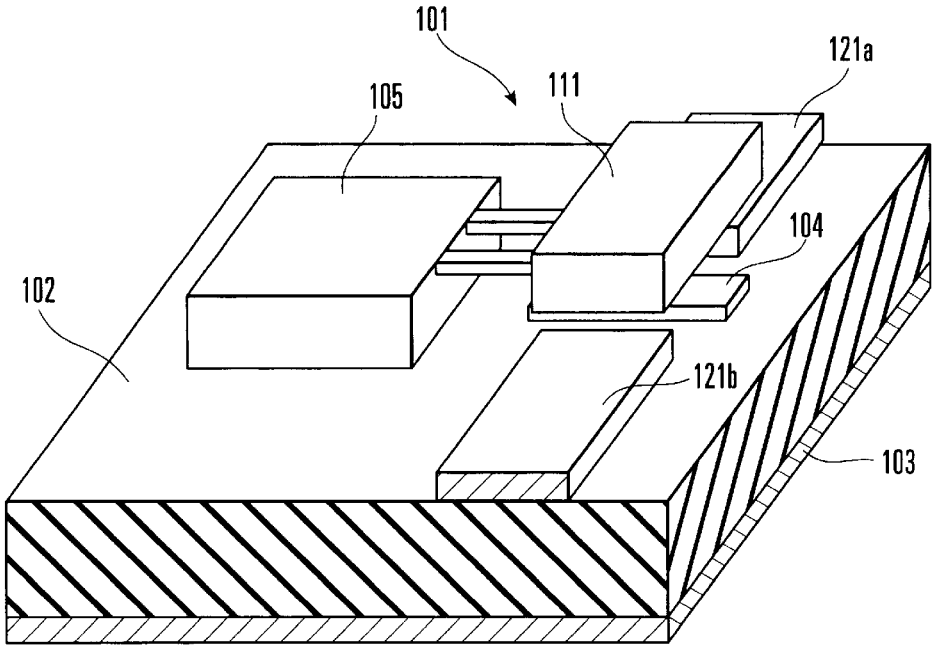
FIG. 21 is a perspective view showing the structure of the conventional switch movable element.
Figure 22:
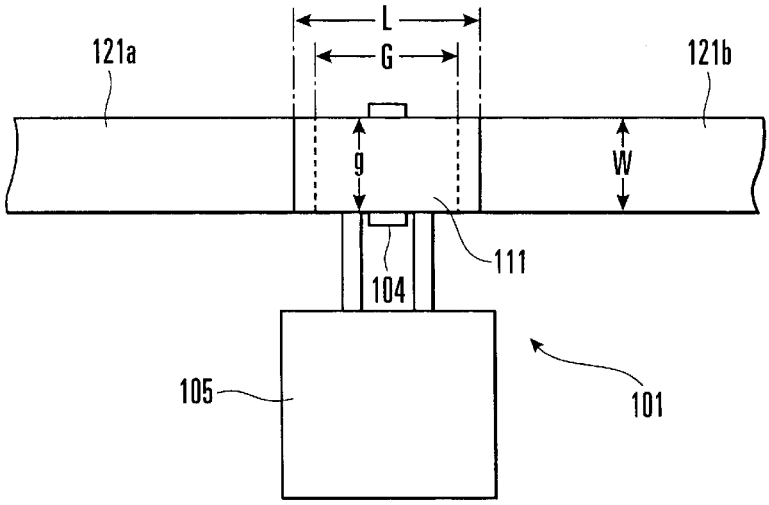
FIG. 22 is a plan view of the micromachine switch shown in FIG. 21.

In the conventional micromachine switch 101 shown in FIG. 21, the switch movable element 111 has a rectangular shape, and the width g of the switch movable element 111 is equal to the width W of each of the microstrip lines 121*a* and 121*b*. Therefore, the opposing area between the switch movable element 111 and the microstrip lines 102*a* and 102*b* becomes (L−G)×W.

In contrast to this, in the micromachine switch 1 shown in FIG. 1, only the distal end portions of the projections 32*a* and 32*b* or projections 32*c* and 32*d* of the switch movable element 11 oppose the microstrip lines 21*a* or 21*b*. Therefore, the opposing area between the switch movable element 11 and the microstrip lines 21*a* and 21*b* becomes (L−G)×(W−b).

In this manner, since the opposing area can be decreased by notching the overlap portions of the switch movable element 11, the capacitance formed between the switch movable element 11 and microstrip lines 21*a* and 21*b* can be decreased. Since this weakens the coupling between the microstrip lines 21*a* and 21*b*, energy leakage can be suppressed in the OFF state of the micromachine switch 1.

On the other hand, assume that a positive voltage is applied to the switch electrode 4 as a control voltage. In this case, positive charges appear on the surface of the switch electrode 4. Also, negative charges appear on the surface of the switch movable element 11 opposing the switch electrode 4 by electrostatic induction. An attraction force is generated by the electrostatic force between the positive charges of the switch electrode 4 and the negative charges of the switch movable element 11.

As shown in FIG. 5(*b*), this attraction force pulls down the switch movable element 11 toward the switch electrode 4. When the projections 32*a* and 32*b* or projections 32*c* and 32*d* of the switch movable element 11 are brought into contact with the microstrip lines 21*a* or 21*b*, the micromachine switch 1 is turned on. At this time, the high-frequency energy is transmitted from the microstrip line 21*a* to the microstrip line 21*b* through the switch movable element 11.

As described above, the switch movable element 11 is formed such that the synthetic impedance of the switch movable element 11 and the projections 32*a* and 32*b* (or 32*c* and 32*d*) becomes almost equal to the impedance of the microstrip line 21*a* (or 21*b*). With this arrangement, the discontinuous portion of the line is only portions where the switch movable element 11 is in contact with the microstrip lines 21*a* and 21*b*. Therefore, high-frequency energy reflection from the microstrip line 21*a* is small.

Modifications of the switch movable element 11 in the FIG. 1 will be described next. Each of FIGS. 6 to 10 is a plan view showing another shape of the switch movable element 11.

Figure 6:
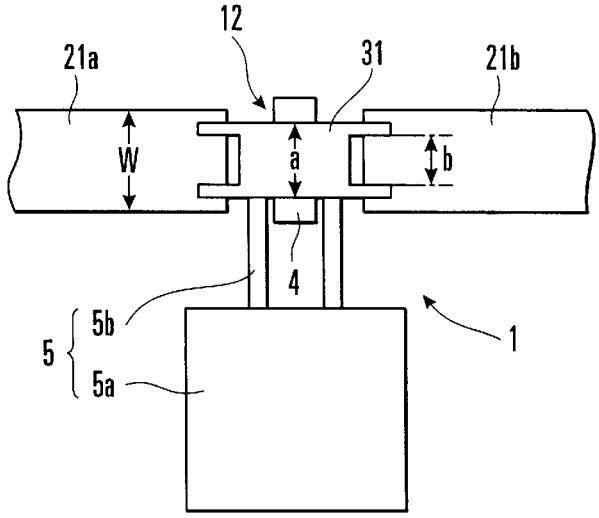
FIG. 6 is a plan view showing another shape of the switch movable element shown in FIG. 1.

In a switch movable element 12 in FIG. 6, the width a of the movable element main body 31 of the switch movable element 11 shown in FIG. 1 is made smaller than the width W of each of the microstrip lines 21*a* and 21*b*.

In some cases, the positioning error occurs in the widthwise direction of the switch movable element 12 in the manufacturing process of the micromachine switch 1. The width a of the movable element main body 31 of the switch movable element 12 is set by considering this positioning error.

With this setting, even if the positioning error occurs in the widthwise direction, all the projections 32*a* and 32*b* or projections 32*c* and 32*d* of the switch movable element 12 can oppose the microstrip lines 21*a* or 21*b*, thereby preventing the degradation of the reflection characteristic of the micromachine switch 1 due to the positioning error.

Figure 7:
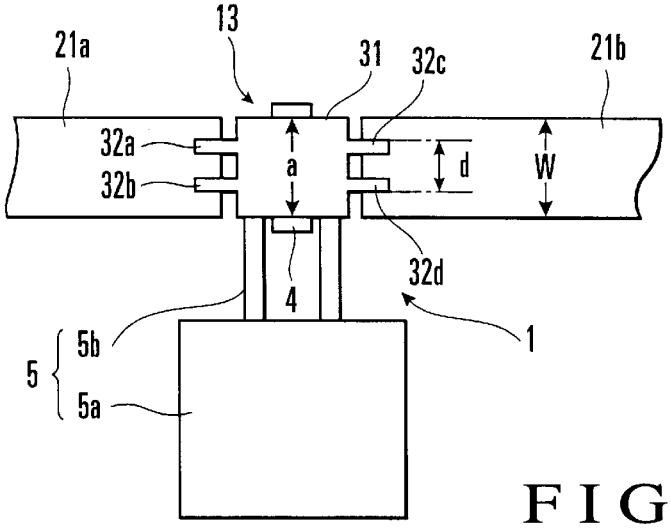
FIG. 7 is a plan view showing still another shape of the switch movable element shown in FIG. 1.

In a switch movable element 13 shown in FIG. 7, two end portions of an overlap portion and a portion between the two ends of an edge of the switch movable element 13 on the microstrip line 21*a* side are notched in a rectangular shape. Thus, rectangular projections 32*a* and 32*b* are formed at a portion between the two ends of one side on the microstrip line 21*a* side. Similarly, rectangular projections 32*c* and 32*d* are formed on the microstrip line 21*b* side.

With this structure, a width d of a portion where the projections 32*a* and 32*b* or projections 32*c* and 32*d* of the switch movable element 13 are formed can be made smaller than the width W of each of the microstrip lines 21*a* and 21*b*. Accordingly, the degradation of the reflection characteristic of the micromachine switch 1 due to the positioning error of the switch movable element 13 in the widthwise direction can be prevented.

Since the width a of the switch movable element 12 in FIG. 6 is smaller than the width W of each of the microstrip lines 21*a* and 21*b*, the characteristic impedance of the movable element main body 31 is made lower than that of the microstrip lines 21*a* and 21*b*, thereby slightly degrading a reflection characteristic.

In contract to this, the width a of the switch movable element 13 shown in FIG. 7 can be made equal to the width W of each of the microstrip lines 21*a* and 21*b*, thereby obtaining the reflection characteristic better than that of the switch movable element 12 if the switch movable element 13 is used.

In some cases, the width a of the movable element main body 31 of the switch movable element 13 may be made smaller or larger than the width W of each of the microstrip lines 21*a* and 21*b*.

Figure 8A:
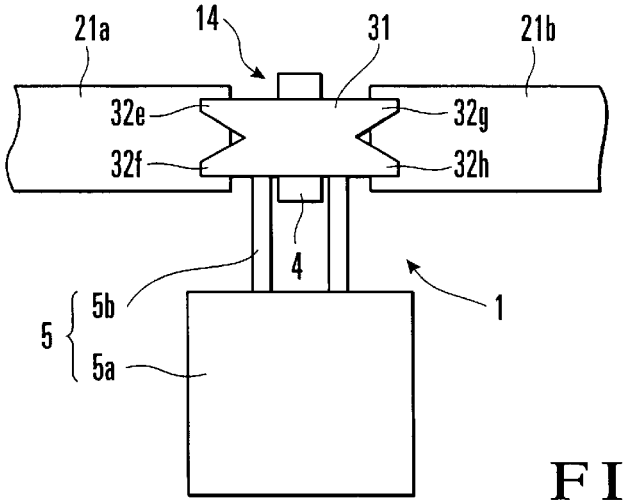
FIGS. 8A and B show plan views of still another shape of the switch movable element shown in FIG. 1.

In a switch movable element 14 in FIG. 8(A), a portion except for the two ends of an overlap portion of an edge of the switch movable element 14 on the microstrip line 21*a* side is notched in a triangular shape. Thus, projections (second projections) 32*e* and 32*f* are formed on the two ends of one side on the microstrip line 21*a* side. Similarly, projections (second projections) 32*g* and 32*h* are formed on the microstrip line 21*b* side.

Figure 8B:
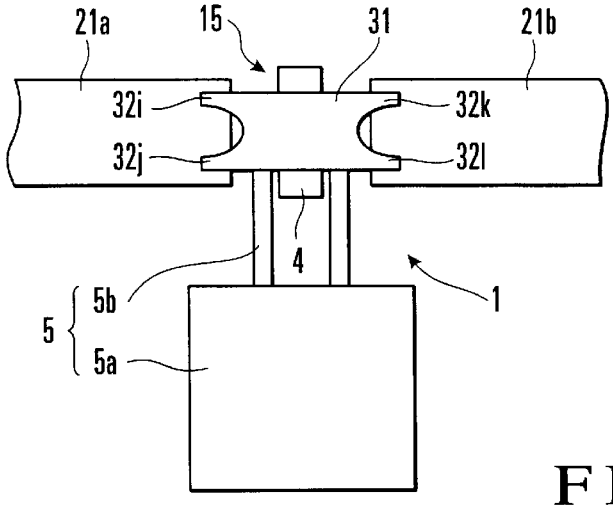

In a switch movable element 15 in FIG. 8(B), the two sides of the switch movable element 15 are notched in an elliptical shape. Thus, projections (second projections) 32*i*, 32*j*, 32*k*, and 321 are formed.

In these projections 32*e* to 321, the width of each projection near the movable element main body 31 is made larger than that away from the movable element main body 31. Therefore, each of the projections 32*e* to 321 in FIGS. 8(A) and 8(B) has a mechanical strength larger than that of each of the rectangular projections 32*a* to 32*d* in FIG. 1.

Figure 9:
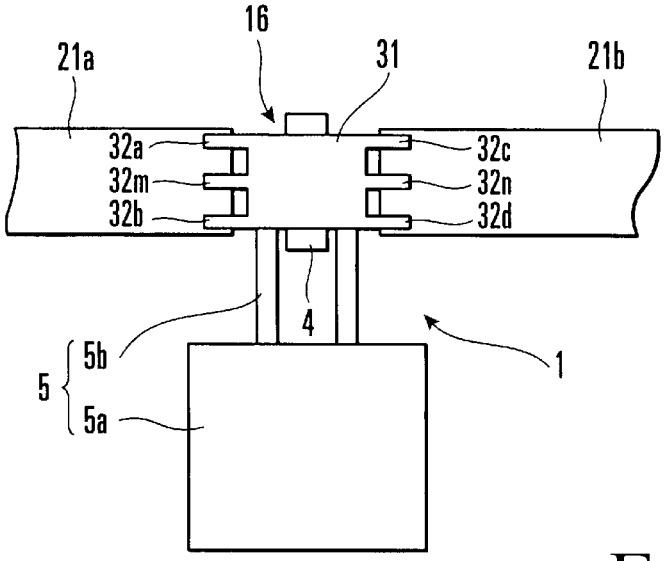
FIG. 9 is a plan view showing still another shape of the switch movable element shown in FIG. 1.

In a switch movable element 16 in FIG. 9, three projections (second projections) 32*a*, 32*b*, and 32*m* and three projections (second projections) 32*c*, 32*d*, and 32*n* are respectively formed on the two ends of the movable element main body 31. The synthetic impedance of the three projections 32*a*, 32*b*, and 32*m* is almost equal to the characteristic impedance of the microstrip line 21*a*. Also, the synthetic impedance of the three projections 32*c*, 32*d*, and 32*n* is almost equal to the characteristic impedance of the microstrip line 21*b*.

Similarly, four or more projections may be formed on each of the two sides of the movable element main body 31.

Figure 10:
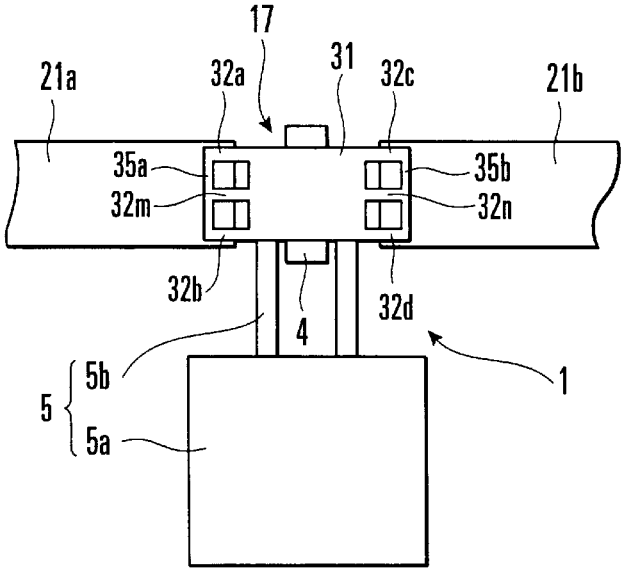
FIG. 10 is a plan view showing still another shape of the switch movable element shown in FIG. 1.

In a switch movable element 17 in FIG. 10, the distal ends of the three projections 32*a*, 32*b*, and 32*m* of the switch movable element 16 in FIG. 9 are connected to each other by a connecting portion 35*a*, and the distal ends of the three projections 32*c*, 32*d*, and 32*n* are connected to each other by a connecting portion 35*b*.

The width of each of the projections 32*a* to 32*d*, 32*m*, and 32*n* of the switch movable element 16 in FIG. 9 is narrow. This may cause distortion of the distal ends of the projections 32*a* to 32*d*, 32*m*, and 32*n* in the vertical direction. When, for example, the distal end of the projection 32*a* distorts in the upward direction, the projection 32*a* is not brought into contact with the microstrip line 21*a* even if the micromachine switch 1 is in the ON state. Thus, the ON reflection characteristic of the micromachine switch 1 degrades.

The connecting portion 35*a* or 35*b* in FIG. 10 prevents distortion of the projections 32*a*, 32*b*, and 32*m* or projections 32*c*, 32*d*, and 32*n*. The distal end portions of the projections 32*a*, 32*b*, and 32*m* or projections 32*c*, 32*d*, and 32*n* are connected by the connecting portions 35*a* or 35*b*, thereby preventing degradation of the reflection characteristic of the micromachine switch 1.

The OFF isolation characteristics and ON reflection characteristics of the micromachine switch 1 shown in FIGS. 1 and 6 and the conventional micromachine switch 101 shown in FIG. 21 will be described next.

Table 1 shows the calculation results of OFF isolation characteristics, which are obtained when predetermined parameters are set. More specifically, the thickness of each of the dielectric substrates 2 and 102 is H=200 μm; the relative dielectric constant of each of the dielectric substrates 2 and 102, ∈r=4.6; the width of each of the microstrip lines 21*a*, 21*b*, 121*a*, and 121*b*, W=370 μm; the gap, G=200 μm; the height of each of the switch movable elements 11 and 111 in the OFF state, h=5 μm; the length of each of the switch movable elements 11 and 111, L=260 μm; and a frequency of a high-frequency energy, 30 GHz. The width a of the movable element main body 31, the notched width b, the length c of the movable element main body 31, and the width g of the switch movable element 111 are shown in Table 1.

TABLE 1

| Switch Movable Element | Parameter | Isolation Characteristic | Reflection Characteristic |
|---|---|---|---|
| 111 | g = 370 μm | 12 dB | −40 or less dB |
| | g = 300 μm | 13 dB | −36 dB |
| | g = 200 μm | 14 dB | −23 dB |
| | g = 100 μm | 18 dB | −17 dB |
| 11 | a = 370 μm<br>b = 270 μm<br>c = 180 μm | 18 dB | −40 dB |
| 12 | a = 300 μm<br>b = 200 μm<br>c = 180 μm | 18 dB | −30 dB |

Letting Ein be an input energy from the microstrip line 21*a* or 121*a* to the switch movable element 11 or 111, and Eout be an output energy output from the switch movable element 11, 12, or 111 to the microstrip line 21*b* or 121*b*, the isolation characteristic is obtained by equation ①.

$$(\text{Isolation characteristic}) = -10\log(Eout/Ein) \quad ①.$$

As is obvious from equation ①, an increase in isolation characteristic value can realize a high degree of isolation.

Further, letting Ere be the reflection energy from switch movable element 11, 12, or 111 to the microstrip line 21*a* or 121*a*, the reflection characteristic is obtained by equation ②.

$$(\text{Reflection characteristic}) = 10\log(Ere/Ein) \quad ②$$

As is obvious in equation ②, a decrease in reflection characteristic value reduces the energy loss.

As shown in Table 1, in the conventional micromachine switch 101, a decrease in width g of the switch movable element 111 improves the OFF isolation characteristics, but degrades the ON reflection characteristics.

In contrast to this, in the micromachine switch 1 shown in FIG. 1, when parameters a to c of the switch movable element 11 are set as shown in Table 1, the value of the OFF isolation characteristic becomes 18 dB. That is, the isolation characteristic similar to that in a case in which the width g of the switch movable element 111 is set to 100 μm in the conventional micromachine switch 101 can be obtained.

On the other hand, the value of the ON reflection characteristic of the micromachine switch 1 shown in FIG. 1 becomes −40 dB. That is, the reflection characteristic similar to that in a case in which the width g of the switch movable element 111 is set to 300 to 370 μm can be obtained.

In this manner, using the micromachine switch 1 shown in FIG. 1 can prevent the degradation of the ON reflection characteristic and improve the OFF isolation characteristic. More specifically, the high degree of isolation in the OFF state and the decrease in loss in the ON state can be simultaneously realized.

In the micromachine switch 1 shown in FIG. 6, since the width a of the movable element main body 31 of the switch movable element 12 decreases, an ON reflection characteristic becomes worse. However, the isolation characteristic similar to that of the micromachine switch 1 shown in FIG. 1 can be obtained.

The micromachine switch 1 shown in each of FIGS. 1 and 6 to 10 is used for a microwave switching circuit, phase shifter, variable filter, or the like. For example, a microwave switching circuit requires an isolation characteristic of approximately 15 dB or more and reflection characteristic of approximately −20 dB or less. Therefore, a good switching characteristic can be obtained by applying the micromachine switch 1 shown in FIG. 1 to the microwave switching circuit.

Note that the required isolation and reflection characteristics change depending on microwave or milliwave circuits to which the micromachine switch 1 is applied. However, desired isolation and reflection characteristics can be selected by setting the sizes L, a, b, and c of the switch movable element 11 or 12 based on the sizes W and G of the microstrip lines 21*a* and 21*b*.

Second Embodiment

Figure 11:
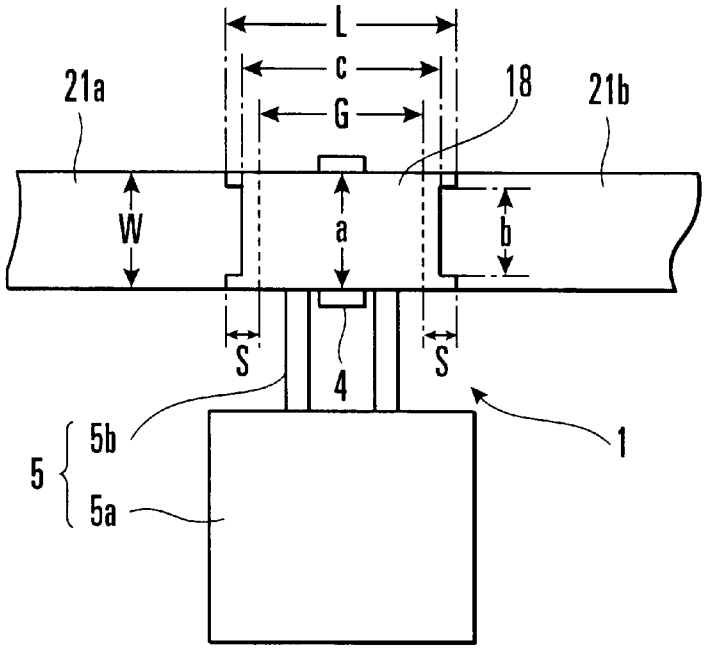
FIG. 11 is a plan view of a micromachine switch according to the second embodiment of the present invention.
Figure 12:
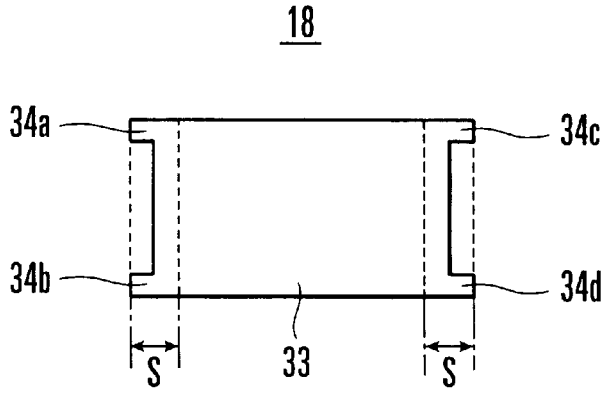
FIG. 12 is a plan view of a switch movable element shown in FIG. 11.

FIG. 11 is a plan view of a micromachine switch according to the second embodiment of the present invention. FIG. 12 is a plan view of a switch movable element 18 shown in FIG. 11. In FIG. 11, the same reference numerals as in FIG. 2 denote the same parts, and a detailed description thereof will be omitted. This also applies to FIGS. 13, 15, and 16 (to be described later).

The switch movable element 18 in FIG. 11 is different from the switch movable element 11 in FIG. 1 in that a length c of a movable element main body 33 is larger than a gap G. In this case, an unnotched portion of the switch movable element 18 is defined as the movable element main body 33. Therefore, projections (second projections) 34*a*, 34*b*, 34*c*, and 34*d* are not included in the movable element main body 33, and the portion except for the projections 34*a* to 34*d* is the movable element main body 33.

Since the length c of the movable element main body 33 is larger than the gap G, not only the projections 34*a* and 34*b* or projections 34*c* and 34*d* of the switch movable element 18 oppose microstrip lines 21*a* or 21*b*, but parts of the movable element main body 33 oppose the microstrip lines 21*a* and 21*b*, respectively.

Thus, the opposing area between the switch movable element 18 and microstrip lines 21*a* and 21*b* in FIG. 11 becomes larger than that between the switch movable element 11 and microstrip lines 21*a* and 21*b* in FIG. 1. By using the switch movable element 18 in FIG. 11, therefore, an OFF isolation characteristic becomes worse than that in use of the switch movable element 11 in FIG. 1. Even if so, the isolation characteristic better than that in the prior art can be obtained.

Since, however, the length c of the movable element main body 33 is larger than the gap G, the projections 34*a* to 34*d* of the switch movable element 18 are not present on the gap G. In addition, a width a of the movable element main body 33 is equal to a width W of each of the microstrip lines 21*a* and 21*b*.

With this arrangement, a discontinuous portion of a micromachine switch 1 in the ON state shown in FIG. 11 is only a portion where the switch movable element 18 is in contact with the microstrip lines 21*a* and 21*b*. By using the switch movable element 18 in FIG. 11, therefore, an ON reflection characteristic similar to that of a conventional micromachine switch 101 can be obtained.

Note that, the width a of the movable element main body 33 has been made equal to the width W of each of the microstrip lines 21*a* and 21*b*. However, the width a of the movable element main body 33 may be changed within the range in which no reflection characteristic greatly degrades.

In addition, the characteristics of the switch movable elements 13 to 17 shown in FIGS. 7 to 10 may be imparted to the switch movable element 18 in FIG. 11.

Third Embodiment

Figure 13:
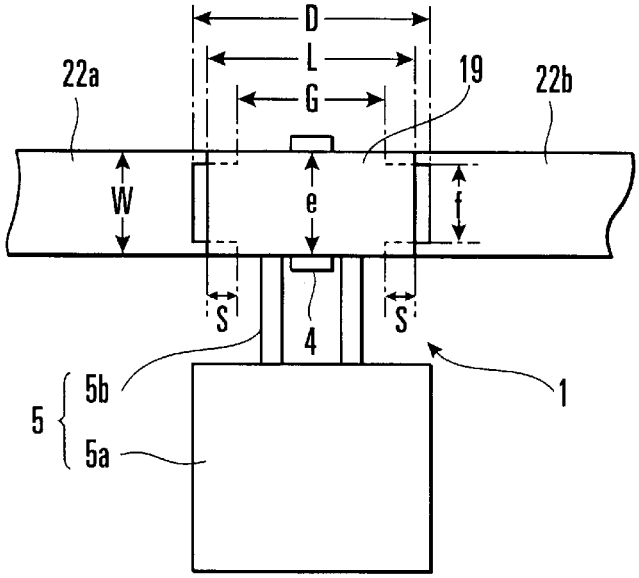
FIG. 13 is a plan view of a micromachine switch according to the third embodiment of the present invention.
Figure 14A:
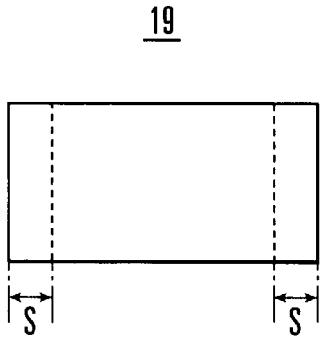
FIGS. 14A and B show plan views of the main part of the micromachine switch shown in FIG. 13.
Figure 14B:
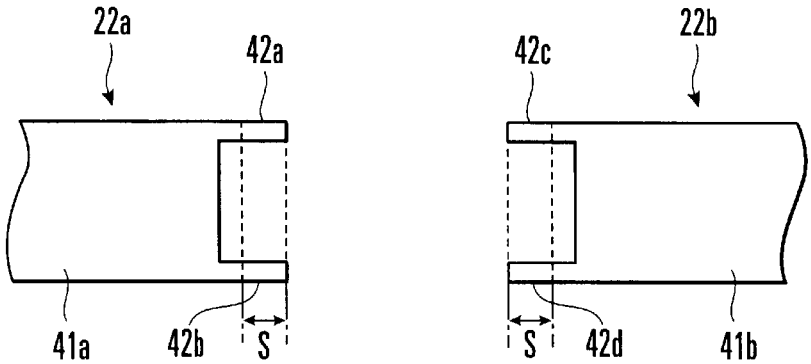

FIG. 13 is a plan view of a micromachine switch according to the third embodiment of the present invention. FIG. 14 shows plan views of the main part of the micromachine switch shown in FIG. 13, in which FIG. 14(A) is a plan view of a switch movable element, and FIG. 14(B) is a plan view of a microstrip line.

As shown in FIG. 13, a switch movable element 19 has a rectangular shape. A length L of the switch movable element 19 is larger than a gap G.

In a microstrip line 22*a*, a portion of an edge of the microstrip line 22*a* on the switch movable element 19 side except for the two ends is notched in a rectangular shape having a width f (a portion of an edge of the microstrip line 22*a*, a microstrip line 22*b*, a microstrip line 24*a*, or a microstrip line 24*b* on the switch movable element 19 side will be referred to as an overlap portion of the microstrip line 22*a*, 22*b*, 24*a*, or 24*b*, hereinafter). Thus, rectangular projections (first projections) 42*a* and 42*b* are formed on the two ends of one side of a line main body 41*b* on the switch movable element 19 side. Similarly, the microstrip line 22*b* has rectangular projections (first projections) 42*c* and 42*d* on the two ends of one side on the switch movable element 19 side.

In this case, unnotched portions of the microstrip lines 22*a* and 22*b* are defined as a line main body 41*a* and the line main body 41*b*, respectively. Therefore, projections 42*a* and 42*b* or projections 43*c* and 42*d* are not included in the line main body 41*a* or 41*b*, and the portions of the microstrip line 22*a* or 22*b* except for the projections 42*a* and 42*b* or projections 42*c* and 42*d* is the line main body 41*a* or 41*b*. A width e of the switch movable element 19 is equal to a width W of the line main body 41*a* or 41*b* of the microstrip line 22*a* or 22*b*.

A distance D between the line main bodies 41*a* and 41*b* is larger than a length L of the switch movable element 19. With this structure, the line main bodies 41*a* and 41*b* do not oppose the switch movable element 19. That is, only the distal end portions of the projections 42*a* to 42*d* oppose the switch movable element 19.

In this manner, in a micromachine switch 1 shown in FIG. 13, the projections 42*a* and 42*b* or projections 43*c* and 42*d* are formed in the microstrip lines 22*a* or 22*b*, in place of forming the projections 32*a* to 32*d* in the switch movable element 11 in the micromachine switch 1 shown in FIG. 1. Other parts in this embodiment are the same as those in the micromachine switch 1 shown in FIG. 1.

Figure 15:
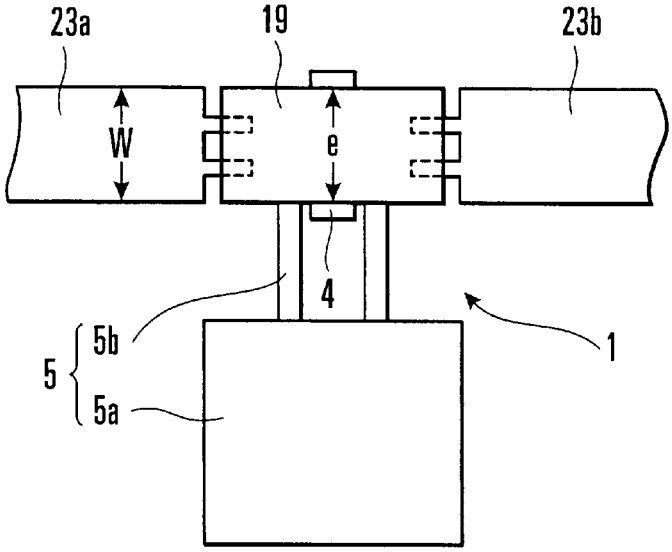
FIG. 15 is a plan view showing another shape of a microstrip line shown in FIG. 13.

As shown in FIG. 15, therefore, the projections 42*a* and 42*b* may be formed on the two ends of one side of a microstrip line 23*a* on the switch movable element 19 side, and the projections 42*c* and 42*d* may be formed on the two ends of one side of a microstrip line 23*b* on the switch movable element 19 side. In addition, the characteristics of the switch movable elements 13 to 17 shown in FIGS. 8 to 10 may be imparted to each of the microstrip lines 22*a* and 22*b* in FIG. 13.

The width e of the switch movable element 19 is made equal to the width W of each of the line main bodies 41*a* and 41*b* but may be larger than the width f of the notch of each of the microstrip lines 22*a* and 22*b*.

Fourth Embodiment

Figure 16:
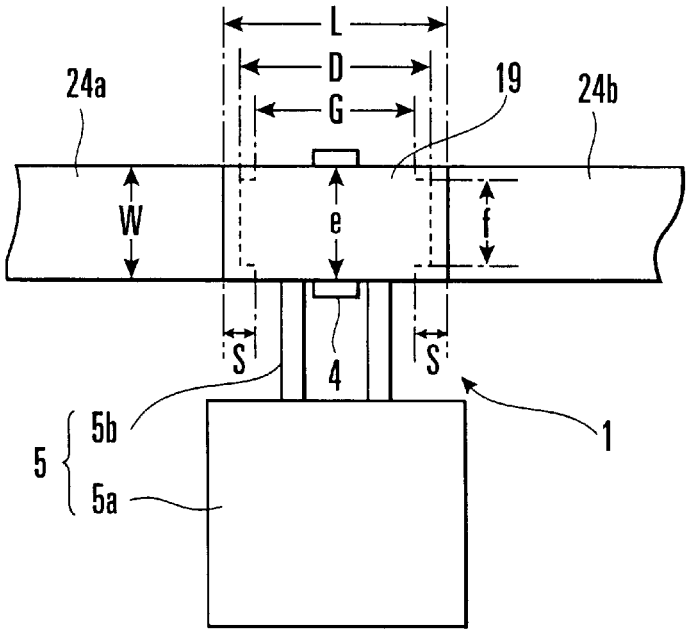
FIG. 16 is a plan view of a micromachine switch according to the fourth embodiment of the present invention.
Figure 17:
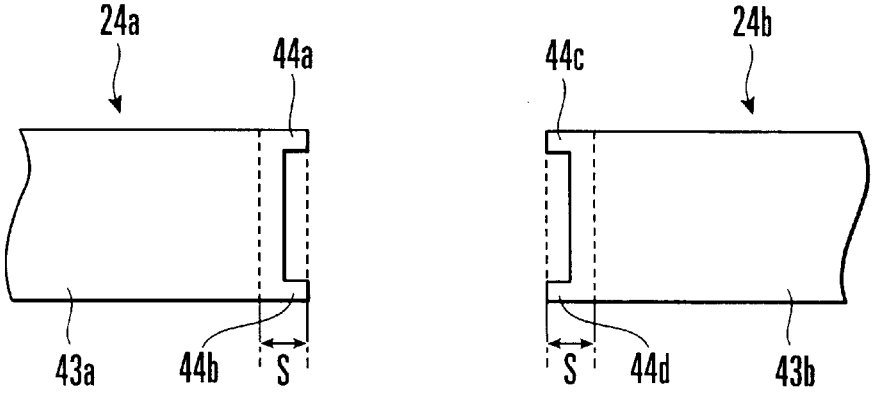
FIG. 17 is a plan view of a microstrip line shown in FIG. 16.

FIG. 16 is a plan view of a micromachine switch according to the fourth embodiment of the present invention. FIG. 17 is a plan view of microstrip lines shown in FIG. 16.

In FIG. 16, microstrip lines 24*a* and 24*b* are different from the microstrip lines 22*a* and 22*b* in FIG. 13 in that a distance D between line main bodies 43*a* and 43*b* is smaller than a length L of a switch movable element 19. In this case, unnotched portions of the microstrip lines 24*a* and 24*b* are defined as the line main bodies 43*a* and 43*b*, respectively. Therefore, projections 44*a* and 44*b* or projections 44*c* and 44*d* are not included in the line main body 43*a* or 43*b*, and the portion of the microstrip line 24*a* or 24*b* except for the projections 44*a* and 44*b* or projections 44*c* and 44*d* is the line main body 43*a* or 43*b*.

Since the distance D is smaller than the length L, not only the projections 44*a* to 44*d* of the microstrip lines 24*a* and 24*b* but a part of each of the line main bodies 43*a* and 43*b* oppose the switch movable element 19.

Other parts in this embodiment are the same as those in the micromachine switch 1 shown in FIG. 13.

Fifth Embodiment

Figure 18:
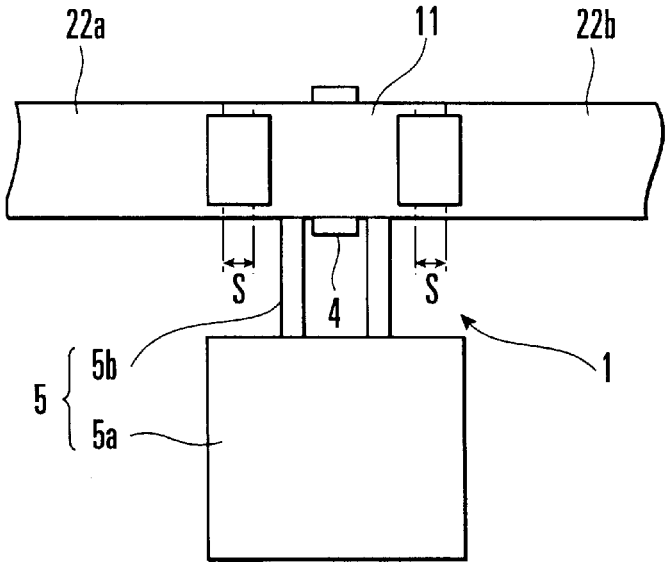
FIG. 18 is a plan view of a micromachine switch according to the fifth embodiment of the present invention.

FIG. 18 is a plan view showing a micromachine switch according to the fifth embodiment of the present invention.

A micromachine switch 1 shown in FIG. 18 is formed by combining the switch movable element 11 shown in FIG. 1 with the microstrip lines 22*a* and 22*b* shown in FIG. 13.

In this case, projections 32*a* and 32*b* of a switch movable element 11 oppose projections 42*a* and 42*b* of a microstrip line 22*a*, respectively. Also, projections 32*c* and 32*d* of the switch movable element 11 oppose projections 42*c* and 42*d* of a microstrip line 22*b*, respectively.

In this manner, even if both switch movable element 11 and microstrip lines 22*a* and 22*b* are notched, the opposing area between the switch movable element 11 and microstrip lines 22*a* and 22*b* can be decreased, thereby improving the OFF isolation characteristic of the micromachine switch 1.

Note that a notch width b of the switch movable element 11 may be equal to or different from a notch width f of each of the microstrip lines 22*a* and 22*b*.

In addition, each of the switch movable elements 12 to 18 may be used in place of the switch movable element 11, and the microstrip lines 23*a* and 23*b* or 24*a* and 24*b* may be used in place of the microstrip lines 22*a* and 22*b*.

As described above, the embodiments of the present invention have been described by using the micromachine switch 1 having the arrangement in which a switch electrode 4 is disposed on a gap G. The present invention is, however, applied to a micromachine switch 6 having the side surface shape shown in FIG. 19.

Figure 19:
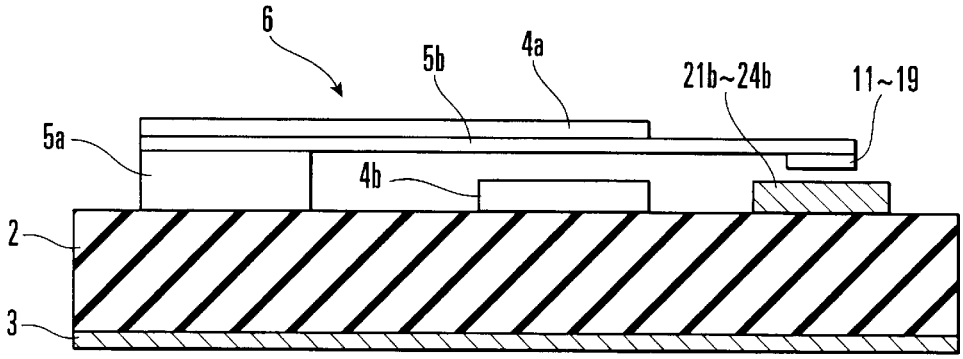
FIG. 19 is a side view showing the side surface of a micromachine switch having another arrangement.

That is, the micromachine switch 9 shown in FIG. 19 has an upper electrode 4*a* and lower electrode 4*b* as switch electrodes (driving means). The lower electrode 4*b* is formed on a dielectric substrate 2, below an arm portion 5*b* of a support means 5, and is not sandwiched between microstrip lines 21*a* and 21*b* (or 22*a* and 22*b*, 23*a* and 23*b*, or 24*a* and 24*b*). The upper electrode 4*a* is tightly formed on the upper surface of the arm portion 5*b*. The upper and lower electrodes 4*a* and 4*b* sandwich the arm portion 5*b* therebetween and oppose each other. The arm portion 5*b* is made of an insulating member.

A driving voltage is selectively applied to at least one of the upper and lower electrodes 4*a* and 4*b*.

The arm portion 5*b* is pulled down by an electrostatic force, and a switch movable element 11 (or 12, 13, 14, 15, 16, 17, 18, or 19) is brought into contact with the microstrip lines 21*a* and 21*b* (or 22*a* and 22*b*, 23*a* and 23*b*, or 24*a* and 24*b*).

Even if the present invention is applied to this micromachine switch 6, the effect described above can be obtained.

In each of the switch movable elements 11 to 18 described above, the two sides of each of the switch movable elements 11 to 18 are notched to form projections 32*a* to 32*n* or 34*a* to 34*d*. However, even if a projection is formed on only one side of each of the switch movable elements 11 to 18, an effect can be obtained.

This also applies to the microstrip lines 22*a* and 22*b*, 23*a* and 23*b*, and 24*a* and 24*b* described above. More specifically, even if projection is formed in only any one of the microstrip lines 22*a*, 23*a*, and 24*a* (or the microstrip lines 22*b*, 23*b*, and 24*b*), an effect can be obtained.

In addition, the micromachine switch 1 or 6 shown in FIG. 1 or 19 connects/disconnects two microstrip lines 21*a* and 21*b* (or 22*a* and 22*b*, 23*a* and 23*b*, or 24*a* and 24*b*) to/from each other. However, the present invention is also applied to the micromachine switch 1 or 6 connecting/disconnecting three or more microstrip lines to/from each other.

In describing the embodiments of the present invention, the microstrip lines 21*a* and 21*b*, 22*a* and 22*b*, 23*a* and 23*b*, and 24*a* and 24*b* are used as distributed constant lines. Even if, however, coplanar lines, triplet lines, or slot lines are used as the distributed constant lines, the same effect can be obtained.

Figure 20A:
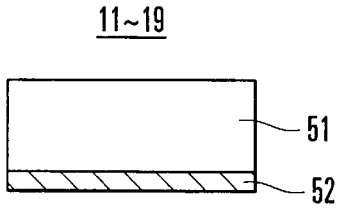
FIGS. 20A and B show sectional views of the sections of the switch movable elements.
Figure 20B:
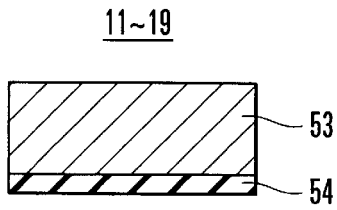

The micromachine switch 1 or 6 described above may be an ohmic contact type micromachine switch or capacitive coupling type micromachine switch. FIG. 20 shows sectional views of sections of the switch movable elements 11 to 19.

In an ohmic contact type micromachine switch 1 or 6, the whole switch movable elements 11 to 19 may be made of conductive members. As shown in FIG. 20(*a*), each of the switch movable elements 11 to 19 may be constructed by a member 51 of a semiconductor or insulator, and a conductive film 52 formed on the entire lower surface of the member 51 (i.e., the surface opposite to the microstrip lines 21*a* and 21*b* or the like). That is, in the switch movable elements 11 to 19, at least the entire lower surface of each of the switch movable elements 11 to 19 may be made of a conductor.

This ohmic contact type micromachine switch 1 or 6 is used within a wide frequency range from a DC to milliwave band.

In addition, as shown in FIG. 20(*b*), a capacitive coupling type micromachine switch 1 or 6 is constructed by a conductive member 53 and insulating thin film 54 formed on the lower surface of the conductive member 53 (i.e., the surface opposing the microstrip lines 21*a* and 21*b* or the like).

An available frequency range of the capacitive coupling type micromachine switch 1 or 6 depends on the thickness of the insulating thin film 54 and is limited within a frequency band of approximately 5 to 10 or more GHz. The available frequency range of the capacitive coupling type micromachine switch is therefore made smaller than that of the ohmic contact type micromachine switch.

In the ohmic contact type micromachine switch, however, the loss is generated by the contact resistance between the microstrip lines 21*a* and 21*b* or the like and the switch movable element 11 or the like. In contrast to this, the capacitive coupling type micromachine switch has no point of contact where the conductors are in direct contact with each other, so no loss due to the contact resistance is generated.

In some cases, thus, the capacitive coupling type micromachine switch may have a loss smaller than that of the ohmic contact type micromachine switch in a high-frequency band (approximately 10 or more GHz but depending on the thickness of insulating thin film 54).

Industrial applicability

A micromachine switch according to the present invention is suitable for a switch device for high-frequency circuits such as a phase shifter and frequency variable filter used in a milliwave band to microwave band.

what is claimed is:

1. A micromachine switch characterized by comprising:

at least two distributed constant lines disposed close to each other;

a movable element arranged above said distributed constant lines such that distal end portions of said movable element oppose said distributed constant lines, respectively, and connect said distributed constant lines to each other in a high-frequency manner upon contacting said distributed constant lines; and driving means for displacing said movable element by an electrostatic force to bring said movable element into contact with said distributed constant lines, wherein said movable element has at least two projections formed by notching an overlap portion of said movable element which is located on at least one distributed constant line side, and the projections oppose a corresponding distributed constant line.

2. A micromachine switch according to claim 1, characterized in that a movable element main body serving as a portion of said movable element except for projections has a width serving as a length in a direction parallel to the widthwise direction of said distributed constant lines to be equal to a width of each of said distributed constant lines, and a portion of the overlap portion of said movable element except for two ends in said movable element is notched.

3. A micromachine switch according to claim 1, characterized in that a movable element main body serving as a portion of said movable element except for projections has a width serving as a length in a direction parallel to the widthwise direction of said distributed constant lines to be smaller than a width of each of said distributed constant lines, and a portion of the overlap portion of said movable element except for two ends in said movable element is notched.

4. A micromachine switch according to claim 1, characterized in that a portion of said movable element having the projections is formed by notching two ends of the overlap portion of said movable element such that a width serving as a length in a direction parallel to the widthwise direction of said distributed constant lines is smaller than a width of each of said distributed constant lines.

5. A micromachine switch according to claim 4, characterized in that the width of the movable element main body serving as a portion of said movable element except for the projections is equal to the width of said distributed constant lines.

6. A micromachine switch according to claim 1, characterized in that each of the projections of said movable element has a rectangular shape.

7. A micromachine switch according to claim 1, characterized in that a length, measured from an end of one of said at least two projections to an opposing end of an opposing one of said at least two projections, is larger than a space between said at least two distributed constant lines.

8. A micromachine switch according to claim 1, characterized in that said movable element has a connection portion for connecting distal ends of the projections to each other.

9. A micromachine switch according to claim 1, characterized in that said at least one distributed constant line opposing the projections of said movable element does not oppose a movable element main body serving as a portion of said movable element except for the projections.

10. A micromachine switch according to claim 1, characterized in that said at least one distributed constant line opposing the projections of said movable element also opposes a movable element main body serving as a portion of said movable element except for the projection.

11. A micromachine switch according to claim 1, characterized in that at least an entire lower surface of said movable element is made of a conductor.

12. A micromachine switch according to claim 1, characterized in that said movable element is made of a conductive member, and an insulating thin film formed on an entire lower surface of the conductive member.

13. A micromachine switch characterized by comprising:

at least two distributed constant lines disposed close to each other;

a movable element arranged above said distributed constant lines such that distal end portions of said movable element oppose said distributed constant lines, respectively, and include a conductor; and driving means for displacing said movable element by an electrostatic force to bring said movable element into contact with said distributed constant lines, wherein at least one of said distributed constant lines has at least two projections formed by notching an overlap portion of said at least one of said distributed constant lines, and the projections oppose said movable element.

14. A micromachine switch according to claim 13, characterized in that a width of said movable element serving as a length in a direction parallel to the widthwise direction of said distributed constant lines is equal to a width of a distributed constant line main body serving as a portion of said at least one of said distributed constant lines except for the projections, and said at least one distributed constant line having the projections has a notched portion of the overlap portion of said at least one distributed constant line except for two ends.

15. A micromachine switch according to claim 13, characterized in that a width of said movable element serving as a length in a direction parallel to the widthwise direction of said distributed constant lines is larger than a width of a distributed constant line main body serving as a portion of said at least one of said distributed constant lines except for the projections, and said at least one of said distributed constant lines having the projections has a notched portion of the overlap portion of said at least one of said distributed constant lines except for two ends.

16. A micromachine switch according to claim 13, characterized in that a portion of said at least one of said distributed constant lines having the projections is formed by notching two ends of the overlap portion of said at least one of said distributed constant lines on the movable element side such that a width of a portion at which the projections are formed is smaller than a length in a direction parallel to the widthwise direction of said distributed constant lines.

17. A micromachine switch according to claim 16, characterized in that the width of said movable element is equal to the width of a distributed constant line main body serving as a portion of said at least one of said distributed constant lines except for the projections.

18. A micromachine switch according to claim 13, characterized in that each of the projections has a rectangular shape.

19. A micromachine switch according to claim 13, characterized in that said movable element does not oppose a distributed constant line main body serving as a portion, except for the projections, of said at least one of said distributed constant lines having the projections.

20. A micromachine switch according to claim 13, characterized in that said movable element also opposes a part of a distributed constant line main body, which serves as a portion except for the projection of said at least one of said distributed constant lines having the projections.

21. A micromachine switch according to claim 13, characterized in that at least an entire lower surface of said movable element is made of a conductor.

22. A micromachine switch according to claim 13, characterized in that said movable element is made of a conductive member, and an insulating thin film formed on an entire lower surface of the conductive member.

23. A micromachine switch characterized by comprising:

at least two distributed constant lines disposed close to each other;

a movable element arranged above said distributed constant lines such that distal end portions of said movable clement oppose said distributed constant lines, respectively, and connect said distributed constant lines to each other in a high-frequency manner upon contacting said distributed constant lines; and driving means for displacing said movable element by an electrostatic force to bring said movable element into contact with said distributed constant lines, wherein at least one of said distributed constant lines has at least two first projections formed by notching an overlap portion of said at least one of said distributed constant lines, and said movable element has at least two second projections so formed as to oppose the first projections of said at least one of said distributed constant lines by notching an overlap portion of said movable element.

* * * * *